US008033207B1

(12) United States Patent
Smith

(10) Patent No.: US 8,033,207 B1
(45) Date of Patent: Oct. 11, 2011

(54) ELECTRICALLY ACTUATED WEAPON SYSTEM

(75) Inventor: Wayne W. Smith, Columbia, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 118 days.

(21) Appl. No.: 12/466,754

(22) Filed: May 15, 2009

Related U.S. Application Data

(60) Provisional application No. 61/059,471, filed on Jun. 6, 2008.

(51) Int. Cl.
*F41A 19/58* (2006.01)
*F41A 19/59* (2006.01)
*F41A 19/64* (2006.01)

(52) U.S. Cl. ..... 89/28.1; 89/28.05; 89/28.2; 89/135; 42/84

(58) Field of Classification Search ..... 89/28.05, 89/28.1, 28.2; 42/84
See application file for complete search history.

(56) References Cited

U.S. PATENT DOCUMENTS

| | | | | |
|---|---|---|---|---|
| 4,991,489 | A * | 2/1991 | Lindberg | 89/6.5 |
| 5,949,015 | A * | 9/1999 | Smith et al. | 89/41.05 |
| 6,237,462 | B1 * | 5/2001 | Hawkes et al. | 89/41.05 |
| 7,404,268 | B1 * | 7/2008 | Page | 42/137 |
| 7,699,683 | B2 * | 4/2010 | Caspi | 446/456 |
| 2008/0034952 | A1 * | 2/2008 | Krause et al. | 89/33.17 |

* cited by examiner

*Primary Examiner* — Bret Hayes
*Assistant Examiner* — Joshua Freeman
(74) *Attorney, Agent, or Firm* — Henry S. Goldfine

(57) ABSTRACT

An electrically actuated weapon system is provided, which may be mounted in a robotic vehicle or device, and controlled remotely by a user. In particular, the electrically actuated weapon system is composed of an electrically actuated weapon, a weapon control means connected thereto, and a controller means remotely located therefrom. The controller means is in wireless communication with the weapon control means, which is operable to control three linear actuators which cycle the weapon. These linear actuator means are controlled electronically, based on communications received from the controller means. Accordingly, if the weapon is stolen, lost, or captured by an enemy combatant during combat, the weapon will cease to be functional. Further, the weapon can be reliably operated from remote locations, as the cycling of the weapon is not dependent upon recoil forces.

4 Claims, 10 Drawing Sheets

ELECTRICALLY ACTUATED WEAPON SYSTEM

CROSS-REFERENCES TO RELATED APPLICATIONS

This application claims the benefit of U.S. Provisional Application Ser. No. 61/059,471, filed on Jun. 6, 2008, entitled "Electrically Actuated Weapon System", which is incorporated herein by reference.

STATEMENT OF GOVERNMENT INTEREST

The invention described herein may be manufactured, used and/or licensed by or for the U.S. Government for governmental purposes, without the payment of royalties by the U.S. Government to the inventors or any future assignees.

FIELD OF THE INVENTION

The present invention relates generally to an electronically controlled weapon system. In particular, the present invention provides a weapon in which the cycling operation of the weapon is performed by electrical actuators which are remotely controlled by an electronic control system, thereby enabling a user to restrict the use of the weapon to only authorized users.

BACKGROUND OF THE INVENTION

Automatic guns can be generally classified, according to their mode of operation, as either self-powered or externally powered. Self-powered automatic guns utilize recoil or high pressure barrel gasses caused by firing to cycle operating mechanisms which load and fire the gun. In particular, a mechanically actuated firing pin strikes a primer cap at the rear of the weapon cartridge, to thereby ignite the propellant for the projectile. The bolt is driven rearward by the propellant gases shortly after the firearm is fired. This action, i.e., "cycling" of the weapon, pulls the spent cartridge from the chamber and ejects the empty shell. Once the bolt reaches the end of travel, the bolt suddenly stops. A spring then provides forward bias to drive the bolt forward and pushes a new cartridge in the chamber.

Self-powered automatic guns are inherently more portable or mobile than externally-powered guns, in which operating mechanisms of externally-powered guns are driven by actuators or motors independently of firing forces, are, therefore, usually preferred for small arms, machine guns and light cannons. However, for larger cannons, external powered actuators are sometimes needed to operate the weapon systems, including loading, cycling, and gun aiming movement. Since such larger guns are difficult to implement as self-powered guns, because of shell size, weight and size of moving operational gun parts, larger guns have typically been constructed to be contrast.

However, automation of guns in general, and large guns in particular, such as those used in tanks and armored vehicles in particular, has heretofore usually been limited to the automation of a single operational function. For example, an actuator has been used for opening and closing the breech, or loading shells into an open breech. A human operator has ordinarily functioned to operationally bridge the separately automated functions. Firing rates of such guns, in which an operator performs the key role as system integrator, have thus been limited by the operator's skill and ability in perceiving the operational status of the automated gun hardware and in deciding when the operating commands should be given to initiate each successive automated operation.

Many problems encountered in mechanizing (automating) large guns are attributable to the fact that the guns were not originally designed for automatic operation. Thus, design of such guns has principally involved adaptations of pre-existing, manually operated guns. As a consequence, their automation has usually consisted of little more than the retrofitting of existing gun hardware. Although some limited success has been achieved through such retrofitting, the resulting gun systems have, at best, been awkward and non-optimal in terms of gun operating speeds and firing rates, and also in terms of system cost and reliability.

Moreover, control systems for previously automated large caliber guns have controlled only a few sequential steps, and have been implemented by simple and/or logic elements, flip-flop circuits typically being used to control actuating motors, or solenoids. Further, the progression from one separately automated step to another has heretofore been sequenced by pre-set timers, so that gun operation proceeds in accordance with a fixed time schedule. Reliance upon such timing schedules, however, can cause serious problems because operating times may, in fact, vary widely in the same gun according to conditions. For example, the time required to advance shells to the gun typically varies according to the number, and hence the mass, of shells which must be advanced.

Operating times also depend upon such factors as how clean or how well lubricated the gun is, the extent of gun wear and the operating temperatures. If the gun design does not take such time-affecting variables into consideration, one operating step may be initiated before a preceding step is completed, with potentially disastrous consequences. A particular event which is difficult to provide for in a fixed timing schedule is shell firing time. Typically shells fire within a few milliseconds after firing impact or, as the case may be, electrical contacting. Propellant combustion ordinarily occurs within the next few milliseconds and casing pressure is typically reduced to a safe casing extraction level in several more milliseconds. Thus, only about 10 to 20 milliseconds of firing "dwell time" is ordinarily required.

However, in system use, a few shells, presumably due to manufacturing defects, do not fire as expected. Instead, there is a brief delay after impact or electrical contact before ignition occurs. This phenomenon is commonly referred to as a "hang fire" condition. If a hang fire causes a shell to fire after a timed casing extraction has begun, the gun may be destroyed and operating personnel may be injured. On the other hand, if worst case hang fires are considered in establishing the gun operating time schedule, gun performance will be compromised. If the timing schedule also takes into account all other possible worst case conditions affecting gun operating times, the firing rate will be drastically reduced over that possible under most operating conditions. As a result, the automatic operation of a gun on a fixed timing schedule is generally unsatisfactory.

Further, currently, robotic devices have begun to be commonly used in police and military applications. Systems for mounting firearms on such robotic devices have been recently developed. These systems for mounting firearms on robotic devices are designed, however, to utilize conventional gas-powered (self-powered) weapons. In particular, the weapon, such as a conventional shotgun or an M-4, is removably mounted in the system, wherein the system allows a user to wirelessly control mechanical mechanisms to release the weapon safety switch and pull the trigger.

However, such conventional systems for mounting firearms on robotic devices have several drawbacks. First, an enemy can disable the robotic device, remove the firearm from the mounting system, and utilize the firearm against the controller of the robotic device and/or friendly forces. Second, as discussed above, self-powered weapons tend to periodically jam, and require human interaction to clear the jam when same occurs, placing the operator in a potentially fatal situation. Third, by requiring placement of a conventional weapon in the mounting system, a soldier usually must place his weapon into the mounting system of the robotic device during operation thereof, which personally places the operator in a vulnerable position during operation of the robotic device.

It is, therefore, an object of the present invention to provide an externally-powered, electrically actuated weapon, in which all firing operations of the weapon can be remotely externally operated.

It is another object of the present invention is to provide an externally-powered, electrically actuated weapon which, if removed from the device upon which the weapon is mounted, such as a robotic device, is inoperable.

A further object of the present invention is to provide an externally-powered electrically actuated weapon which operates on a strict logic basis, rather than on a fixed timing schedule, which stops operating if pre-established logic conditions are not met, and which provides status and malfunction information to the gun operator.

Another object of the present invention is to provide an externally-powered, electrically actuated weapon in which initiation of each operational step is conditioned on specific moving parts of the gun being in specific positions.

SUMMARY OF THE INVENTION

In order to achieve the objects of the present invention, as described above, the present inventor earnestly endeavored to develop an electrically actuated weapon, in which all firing operations are performed by means external to the firing operation. In particular, in a first embodiment of the present invention, an electrically actuated weapon system is provided comprising:

(A) a controller means;

(B) a wireless communication means in communication with the controller means;

(C) a wireless receiver means capable of wireless communication with the wireless communication means;

(D) a weapon control means in communication with the wireless receiver means, said weapon control means operable to control firing operation of the weapon via linear actuator means; and (E) an electrically actuated weapon in communication with the weapon control means, the electrically actuated weapon comprised of a:

(1) a feeder linear actuator means operable to control feeding of ammunition into the weapon;

(2) a cam actuator means operable to control firing operation of the weapon; and (3) an extractor linear actuator means operable to extract fired weapon cartridges from the weapon.

In a second embodiment of the present invention, the electrically actuated weapon system of the first embodiment of the present invention is provided, wherein the electrically actuated weapon comprises:

(a) a weapon housing having a rear end, a front end having a threaded cylindrical portion formed therein, said front end disposed opposite the rear end, and a middle portion disposed between the front end and the rear end, said weapon housing comprising:

(i) an extractor piston track defined by the weapon housing, said extractor piston track comprised of an extractor piston track bore, and an extractor actuator through-slot extending from the piston track bore to the exterior of the weapon housing;

(ii) a cartridge feeder piston track defined by the weapon housing, disposed parallel to the extractor piston track bore, said cartridge feeder piston track comprised of a feeder piston track bore having a rear end, a front end, and a feeder actuator through-slot extending from the feeder piston bore to the exterior of the weapon housing;

(iii) a cartridge magazine through-slot defined by the weapon housing, disposed perpendicular to the extractor piston track, and in communication with the extractor piston track bore;

(iv) a transition cavity defined by the weapon housing, disposed perpendicular to and in communication with both the extractor piston track bore and the cartridge feeder piston track bore, serving to connect the extractor piston track bore to the cartridge feeder piston track bore;

(v) a cartridge magazine locking assembly bore disposed parallel to the extractor piston track bore, and extending from the rear end of the weapon housing to the cartridge magazine through-slot;

(vi) a firing pin cam bore defined by the weapon housing, disposed perpendicular to the cartridge feeder piston track bore, and extending from the exterior of the weapon housing to the cartridge feeder piston track bore;

(vii) a cartridge restrictor pivot bore defined by the weapon housing, disposed between and perpendicular to both the extractor piston track bore and the cartridge feeder piston track bore, and extending through the weapon housing;

(viii) an ejector rod bore defined by the weapon housing, disposed perpendicular and off axis to the cartridge feeder piston track bore;

(iv) a cartridge magazine locking assembly handle slot defined by the weapon housing, disposed perpendicular to the cartridge magazine locking assembly bore, and extending from the exterior of the weapon housing to the cartridge magazine locking assembly bore; and (x) a cartridge ejection slot defined by the weapon housing, disposed perpendicular to and off axis of the cartridge feeder piston track bore, and in the same plane as the ejector rod bore;

(b) a cartridge magazine locking assembly movably disposed in the cartridge magazine locking assembly bore, said cartridge magazine locking assembly comprising:

(i) a cartridge magazine locking assembly piston having a rear end and a front end, slidably disposed within the cartridge magazine locking assembly bore;

(ii) a handle in communication with the cartridge magazine locking assembly piston, perpendicular thereto, slidably disposed within the cartridge magazine locking assembly handle slot;

(iii) a spring having a first end and a second end, disposed within the cartridge magazine locking assembly bore, the second end of the spring being disposed adjacent to the rear end of the cartridge magazine locking assembly piston;

(iv) a plug removably disposed at the rear end of the cartridge magazine locking assembly bore, and adjacent to the first end of the spring;

(c) a cartridge extractor piston assembly disposed within the extractor piston track bore, said cartridge extractor piston assembly comprised of:

(i) a cartridge extractor piston slidably disposed within the extractor piston track bore;

(ii) an extractor actuator rod having a first end and second end, disposed perpendicular to the cartridge extractor piston, slidably within the extractor actuator through-slot, and in communication with the cartridge extractor piston at the first end of the extractor actuator rod;

(iii) an extractor linear actuator means disposed adjacent to the weapon housing, and in communication with the weapon control means so as to controlled thereby, and the second end of the extractor actuator rod, such that the extractor linear actuator means may slide the cartridge extractor piston within the extractor piston track bore via the extractor actuator rod;

(d) an ejector rod disposed within the ejector rod bore, perpendicular and off axis to the cartridge feeder piston track bore;

(e) a cartridge feeder piston assembly disposed within the feeder piston track bore, said cartridge feeder piston assembly comprised of:

(i) a cartridge feeder piston having a first end, a second end, and a circumferential portion disposed there between, the cartridge feeder piston slidably disposed within the feeder piston track bore, said cartridge feeder piston further comprising:

(A) a firing pin bore disposed through the side cartridge feeder piston, from the first end of the piston to the second end of the piston, the firing pin bore having a diameter adjacent the first end of the cartridge feeder piston smaller than a diameter adjacent the second end of the cartridge feeder piston;

(B) a firing pin slot defined by the cartridge feeder piston, disposed perpendicular to firing pin bore and extending from the exterior of the cartridge feeder piston to the firing pin bore, the firing pin slot having a width small than the diameter of the firing pin bore;

(C) a plurality of extractor finger grooves formed in and defined by the cartridge feeder piston;

(D) an extractor finger disposed within each of the extractor finger grooves, each extractor finger composed of a flexible memory retaining material (such as spring steel) capable of temporarily deforming so as to grasp the rear lip of the ammunition cartridge;

(E) an ejector rod groove disposed within the cartridge feeder piston, extending the entire length thereof.

(F) a firing pin slidably disposed within the firing pin bore and the firing pin slot;

(G) a firing pin spring having a first end and a second end, disposed within the firing pin bore, the second end of the spring being disposed adjacent to the rear end of the firing pin;

(H) a plug removably disposed at the rear end of the firing pin bore, and adjacent to the first end of the spring;

(ii) a feeder actuator rod having a first end and second end, disposed perpendicular to the cartridge feeder piston, slidably disposed within the feeder actuator through-slot, and in communication with the cartridge feeder piston at the first end of the feeder actuator rod;

(iii) a feeder linear actuator means disposed adjacent to the weapon housing, and in communication with the weapon control means so as to be controlled thereby, and the second end of the feeder actuator rod, such that the feeder linear actuator means may slide the cartridge feeder piston within the feeder piston track bore via the feeder actuator rod; and (f) a firing pin cam assembly disposed in the firing pin cam bore, said firing pin cam assembly comprised of:

(i) a trigger cam movably disposed within the firing pin cam bore, the trigger cam having a trigger cam hole disposed there through;

(ii) a cam pin disposed within the trigger cam hole, such that the cam pin is in movable communication with the trigger cam;

(iii) a firing pin cam cover disposed on the weapon housing, adjacent the firing pin cam bore;

(iv) a cam actuator rod having a first end and second end, disposed perpendicular to the cam pin rotatably disposed adjacent the firing pin cam bore, and in communication with the cam pin; and (v) a cam actuator means disposed adjacent to the weapon housing, and in communication with the weapon control means so as to be controlled thereby, and with the second end of the cam actuator rod, such that the cam actuator means may rotate the cam actuator rod within the firing pin cam bore via the cam actuator rod.

In a third of the present invention, the electrically actuated weapon system of the first embodiment above is provided, wherein the controller means is a computer processing means or a simple logic control device operable to communicate with the weapon control means.

In a fourth embodiment of the present invention, the electrically actuated weapon system of the first embodiment is provided, wherein the weapon control means is a computer processing means or a simple logic control device, and is capable of controlling operation of the linear actuator means.

In a fifth embodiment of the present invention, the electrically actuated weapon of the second embodiment above is provided, further comprising a weapon barrel having a first end, a second end, a chamber disposed adjacent the first end, and a bore disposed between the chamber and the second end.

In a sixth embodiment of the present invention, the electrically actuated weapon of the first and second embodiments above is provided, wherein the extractor linear actuator means, feeder linear actuator means, and the cam actuator means is an electric, hydraulic or pneumatic linear actuator means.

In a seventh embodiment of the present invention, the electrically actuated weapon system of the first embodiment above is provided, further comprising a power supply in communication with the weapon control means.

In an eighth embodiment of the present invention, the electrically actuated weapon system of the second embodiment above is provided, wherein the electrically actuated weapon further comprises an ammunition supply means, said ammunition supply means in communication with the cartridge magazine through-slot.

In a ninth embodiment of the present invention, the electrically actuated weapon system of the eighth embodiment above is provided, wherein the ammunition supply means is selected from a weapon cartridge, a hopper means, and a belt feeding means.

In a tenth embodiment of the present invention, the electrically actuated weapon system of the second embodiment above is provided, wherein the ejector rod of the electrically actuated weapon is disposed within the ejector rod bore, perpendicular to and off axis at about a 45° angle in relation to the cartridge feeder piston track bore.

In an eleventh embodiment of the present invention, the electrically actuated weapon system of the second embodiment above is provided, wherein the cartridge ejection slot of the electrically actuated weapon is disposed perpendicular to and off axis by about 45° in relation to the cartridge feeder piston track bore, and in the same plane as the ejector rod bore.

In a twelfth embodiment of the present invention, an electrically actuated weapon is provided comprising:

(A) a weapon housing having a rear end, a front end having a threaded cylindrical portion formed therein, said front end disposed opposite the rear end, and a middle portion disposed between the front end and the rear end, said weapon housing comprising:

(i) an extractor piston track defined by the weapon housing, said extractor piston track comprised of an extractor piston track bore, and an extractor actuator through-slot extending from the piston track bore to the exterior of the weapon housing;

(ii) a cartridge feeder piston track defined by the weapon housing, disposed parallel to the extractor piston track bore, said cartridge feeder piston track comprised of a feeder piston track bore having a rear end, a front end, and a feeder actuator through-slot extending from the feeder piston bore to the exterior of the weapon housing;

(iii) a cartridge magazine through-slot defined by the weapon housing, disposed perpendicular to the extractor piston track, and in communication with the extractor piston track bore;

(iv) a transition cavity defined by the weapon housing, disposed perpendicular to and in communication with both the extractor piston track bore and the cartridge feeder piston track bore, serving to connect the extractor piston track bore to the cartridge feeder piston track bore;

(v) a cartridge magazine locking assembly bore disposed parallel to the extractor piston track bore, and extending from the rear end of the weapon housing to the cartridge magazine through-slot;

(vi) a firing pin cam bore defined by the weapon housing, disposed perpendicular to the cartridge feeder piston track bore, and extending from the exterior of the weapon housing to the cartridge feeder piston track bore;

(vii) a cartridge restrictor pivot bore defined by the weapon housing, disposed between and perpendicular to both the extractor piston track bore and the cartridge feeder piston track bore, and extending through the weapon housing;

(viii) an ejector rod bore defined by the weapon housing, disposed perpendicular and off axis to the cartridge feeder piston track bore;

(ix) a cartridge magazine locking assembly handle slot defined by the weapon housing, disposed perpendicular to the cartridge magazine locking assembly bore, and extending from the exterior of the weapon housing to the cartridge magazine locking assembly bore; and (x) a cartridge ejection slot defined by the weapon housing, disposed perpendicular to and off axis of the cartridge feeder piston track bore, and in the same plane as the ejector rod bore;

(B) a cartridge magazine locking assembly movably disposed in the cartridge magazine locking assembly bore, said cartridge magazine locking assembly comprising:

(i) a cartridge magazine locking assembly piston having a rear end and a front end, slidably disposed within the cartridge magazine locking assembly bore;

(ii) a handle in communication with the cartridge magazine locking assembly piston, perpendicular thereto, slidably disposed within the cartridge magazine locking assembly handle slot;

(iii) a spring having a first end and a second end, disposed within the cartridge magazine locking assembly bore, the second end of the spring being disposed adjacent to the rear end of the cartridge magazine locking assembly piston;

(iv) a plug removably disposed at the rear end of the cat tiidge magazine locking assembly bore, and adjacent to the first end of the spring;

(C) a cartridge extractor piston assembly disposed within the extractor piston track bore, said cartridge extractor piston assembly comprised of:

(i) a cartridge extractor piston slidably disposed within the extractor piston track bore;

(ii) an extractor actuator rod having a first end and second end, disposed perpendicular to the cartridge extractor piston, slidably within the extractor actuator through-slot, and in communication with the cartridge extractor piston at the first end of the extractor actuator rod;

(iii) an extractor linear actuator means disposed adjacent to the weapon housing, and in communication with the second end of the extractor actuator rod, such that the extractor linear actuator means may slide the cartridge extractor piston within the extractor piston track bore via the extractor actuator rod;

(D) an ejector rod disposed within the ejector rod bore, perpendicular and off axis to the cartridge feeder piston track bore;

(E) a cartridge feeder piston assembly disposed within the feeder piston track bore, said cartridge feeder piston assembly comprised of:

(i) a cartridge feeder piston having a first end, a second end, and a circumferential portion disposed there between, the cartridge feeder piston slidably disposed within the feeder piston track bore, said cartridge feeder piston further comprising:

(A) a firing pin bore disposed through the side cartridge feeder piston, from the first end of the piston to the second end of the piston, the firing pin bore having a diameter adjacent the first end of the cartridge feeder piston smaller than a diameter adjacent the second end of the cartridge feeder piston;

(B) a firing pin slot defined by the cartridge feeder piston, disposed perpendicular to firing pin bore and extending from the exterior of the cartridge feeder piston to the firing pin bore, the firing pin slot having a width small than the diameter of the firing pin bore;

(C) a plurality of extractor finger grooves formed in and defined by the cartridge feeder piston;

(D) an extractor finger disposed within each of the extractor finger grooves, each extractor finger composed of a flexible memory retaining material (such as spring steel) capable of temporarily deforming so as to grasp the rear lip of the ammunition cartridge;

(E) an ejector rod groove disposed within the cartridge feeder piston, extending the entire length thereof.

(F) a firing pin slidably disposed within the firing pin bore and the firing pin slot;

(G) a firing pin spring having a first end and a second end, disposed within the firing pin bore, the second end of the spring being disposed adjacent to the rear end of the firing pin;

(H) a plug removably disposed at the rear end of the firing pin bore, and adjacent to the first end of the spring;

(ii) a feeder actuator rod having a first end and second end, disposed perpendicular to the cartridge feeder piston, slidably disposed within the feeder actuator through-slot, and in communication with the cartridge feeder piston at the first end of the feeder actuator rod;

(iii) a feeder linear actuator means disposed adjacent to the weapon housing, and in communication with the second end of the feeder actuator rod, such that the feeder linear actuator means may slide the cartridge feeder piston within the feeder piston track bore via the feeder actuator rod;

(e) a firing pin cam assembly disposed in the firing pin cam bore, said firing pin cam assembly comprised of:

(i) a trigger cam movably disposed within the firing pin cam bore, the trigger cam having a trigger cam hole disposed there through;

(ii) a cam pin disposed within the trigger cam hole, such that the cam pin is in movable communication with the trigger cam;

(iii) a firing pin cam cover disposed on the weapon housing, adjacent the firing pin cam bore;

(iv) a cam actuator rod having a first end and second end, disposed perpendicular to the cam pin rotatably disposed adjacent the firing pin cam bore, and in communication with the cam pin; and (v) a cam actuator means disposed adjacent to the weapon housing, and in communication with the second end of the cam actuator rod, such that the cam actuator means may rotate the cam actuator rod within the firing pin cam bore via the cam actuator rod.

BRIEF DESCRIPTION OF THE DRAWINGS

FIG. 3(*b*) is a partial cross sectional view of the electrically actuated weapon of the present invention, illustrating the firing pin and related components shown in FIG. 3(*a*).

DETAILED DESCRIPTION OF THE INVENTION

Figure 1:
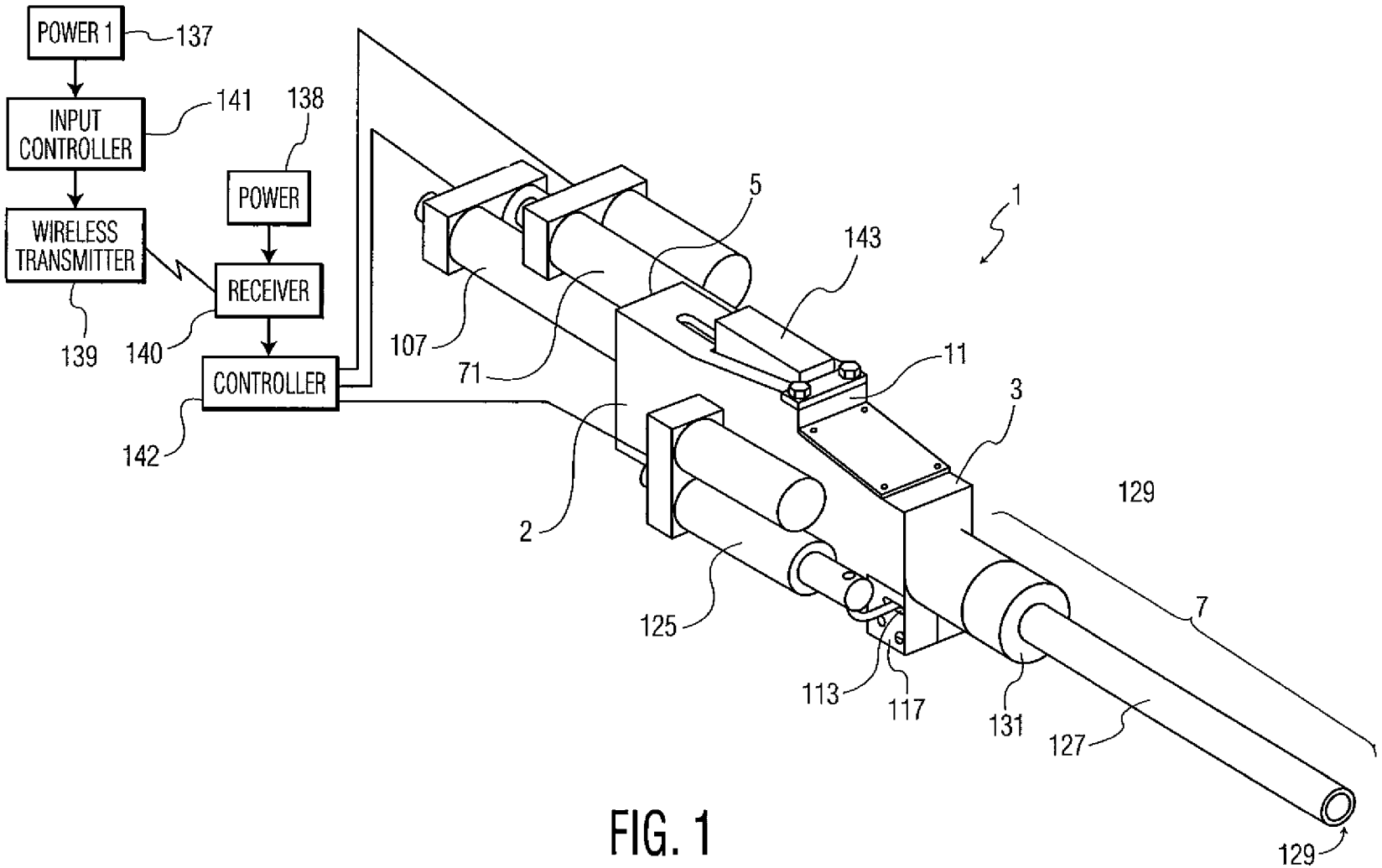
FIG. 1 is a perspective view of the electrically actuated weapon system of the present invention.

As illustrated in FIG. 1, the present invention provides an electrically actuated weapon system 1, comprised of a power supply (not shown), a controller means comprised of a computer processing means (not shown), (which may alternatively be a simple logic control means), and a wireless communication means in connection with the computer processing means. A user is able to remotely control the firing operations of the electrically actuated weapon 1 via a user interface (not shown; any conventional user interface may be utilized) in connection with the controller means, via the wireless communication means.

Importantly, the electrically actuated weapon 1 of the present invention, which may be mounted remotely from the user, such as on a robotic device or vehicle, may not be operated other than via the controller means. In particular, the firing operations of the weapon 1, such as the loading, firing of a weapon cartridge, ejection thereof, and reloading of a weapon cartridge into the weapon 1, are all controlled by linear actuator means (rather than through a gas-operated recoil-based system as conventionally used). These linear actuator means are controlled electronically, based on communications received from the remote controller means. Accordingly, if the weapon 1 is stolen, lost, or captured by an enemy combatant during combat, the weapon 1 will cease to be functional.

The controller means may be a computer processing means, such as a personal computer (PC), Personal Digital Assistants (PDA), hand held computer, palm top computers, lap top computer, smart phone, or any other information processing devices. A PC can be one or more IBM or compatible PC workstations running a Microsoft Windows or LINUX operating system, one or more Macintosh computers running a Mac OS operating system, or an equivalent. In another embodiment, the computer processing means may run through a server system, such as a SUN Ultra workstation running a SunOS operating system or IBM RS/6000 workstation and server running the AIX operating system. However, a simple logic control device may be utilized, in place of such information processing devices, to facilitate simple user control of the electrically actuated weapon 1.

The controller means is in communication with a wireless communication means, so as to enable the user to remotely control the operation of the electrically actuated weapon 1. The wireless communication means may be any conventional wireless communication device, such as a wireless LAN device, radio transmitter, etc. The wireless communication means and controller means are in communication with one or more power supplies.

The wireless communication means is operable to communicate with a wireless receiver means. The wireless receiver means, like the communication means, may be any conventional wireless communication device, such as a wireless LAN device, radio transmitter, etc. The wireless receiver means is in communication with a weapon control means. Like the controller means, the weapon control means may be a computer processing means or a simple logic control device.

As illustrated in FIG. 1, the weapon control means is in communication with a second power supply. A second power supply is required, as the weapon 1 is operated remotely from the controller means. The weapon control means is operable to receive communications (commands) from the controller means concerning operation of the linear actuator means 71, 107 and 125. In particular, during operation, a user wirelessly communicates commands to the weapon 1 from the controller means to the weapon control means.

The controller means, generally, comprises a first switch for powering the extractor linear actuator means 71, a second switch for powering the feeder linear actuator means 107, and a third switch for powering the cam actuator means 125. Specifically, commands to activate one or more of the linear actuator means 71, 107 and 125 (i.e., move the piston of the linear actuator means forward and backward) are sent by the user to the weapon control means (not shown). By activating the linear actuator means 71, 107 and 125, the weapon control means cycles the weapon 1, thereby loading, firing, extracting, and reloading a weapon cartridge, as desired by the user.

The extractor linear actuator means 71, the feeder linear actuator means 107 and the cam actuator means 125 are in conductive communication with the second power supply, either directly or via the weapon control means 112. Each of the linear actuator means 71, 107 and 125, may be an electric, hydraulic or pneumatic linear actuator. Preferably, electric linear actuators are used, due to their quick responsiveness.

Figure 2:
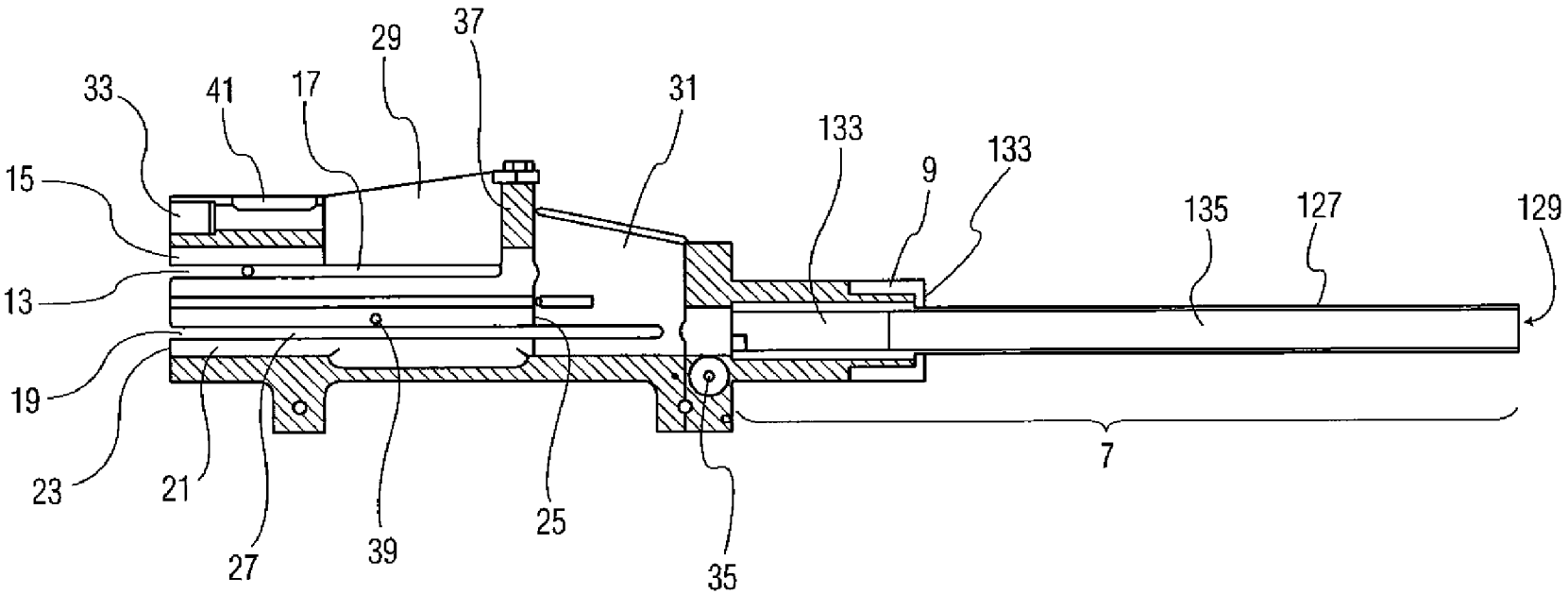
FIG. 2 is a partial cross sectional view of the electrically actuated weapon of the system of the present invention.

As illustrated in FIG. 1, the electrically actuated weapon 2 of the present invention has a weapon housing 3 having a rear end 5, a middle portion 11, and a front end 7. As illustrated in FIG. 2, the front end 7 has a threaded cylindrical portion 9 formed therein. As called for in the second embodiment of the present invention, and as illustrated in FIGS. 1 and 2, a weapon barrel 127, having a first end 129 and a second end 131, may be screwed onto the weapon housing 3 via the threaded cylindrical portion 9 thereof. Further, as shown in FIG. 2, a chamber 133 is disposed in the weapon barrel 127 adjacent the first end 131 thereof, and a bore 135 is disposed between the chamber 133 and the second end 129 of the barrel 127.

The weapon housing 3 defines an extractor piston track 13 having an extractor piston track bore 15, and an extractor actuator through-slot 17 extending from the piston track bore 15 to the exterior of the weapon housing 3.

The weapon housing 3 further defines a cartridge feeder piston track 19 defined by the weapon housing 3, the track 19 being disposed parallel to the extractor piston track bore 15. The cartridge feeder piston track 19 is comprised of a feeder piston track bore 21 having a rear end 23, a front end 25, and a feeder actuator through-slot 27 extending from the feeder piston bore 21 to the exterior of the weapon housing 3.

A cartridge magazine through-slot 29, as shown in FIG. 2, is defined by the weapon housing 3, and is disposed perpendicular to the extractor piston track 13, and in communication with the extractor piston track bore 15. As illustrated in FIG. 1, an ammunition supply means 143 is removably disposed within the cartridge magazine through slot 29. The ammunition supply means may be any conventional weapon cartridge, as shown in FIG. 1. Alternatively, the ammunition supply means may be a hopper device, which feeds weapon cartridges into the weapon 1 via a hopper mechanism, or a conventional belt feeding means, which feeds weapon cartridges to the weapon 1 via a belt.

A transition cavity 31, illustrated in FIG. 2, is defined by the weapon housing 3, and serves to connect the extractor piston track bore 15 to the cartridge feeder piston track bore 21. The transition cavity 31 is disposed perpendicular to and in communication with both the extractor piston track bore 15 and the cartridge feeder piston track bore 21.

A cartridge magazine locking assembly bore 33, illustrated in FIG. 2 adjacent the rear end 5, shown in FIG. 1, of the weapon housing 3, is disposed parallel to the extractor piston track bore 15, and extends from the rear end 5 of the weapon housing 3 to the cartridge magazine through-slot 29.

A firing pin cam bore 35, defined by the weapon housing, is disposed perpendicular to the cartridge feeder piston track bore 25, and extends from the exterior of the weapon housing 3 to the cartridge feeder piston track bore 25. A cartridge restrictor pivot bore 37, defined by the weapon housing 3, is disposed between and perpendicular to both the extractor piston track bore 15 and the cartridge feeder piston track bore 23, and extends through the weapon housing 3.

Figure 8:
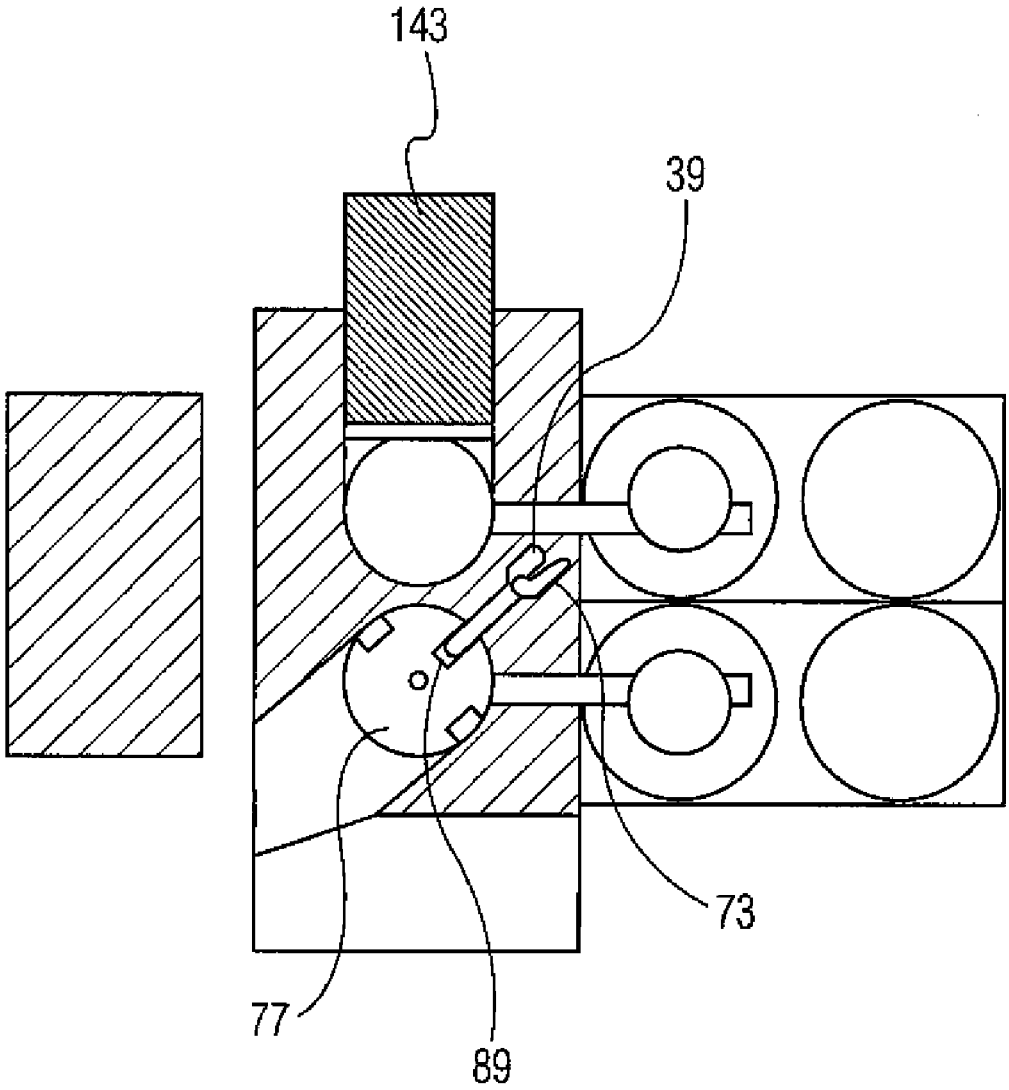
FIG. 8 is a cross sectional view of the electrically actuated weapon of the system of the present invention, taken perpendicular to the view shown in FIG. 2, adjacent the area of the extractor actuator rod 65 shown in FIG. 4.

As illustrated in FIGS. 2 and 8, an ejector rod bore 39 is defined by the weapon housing 3, and is disposed perpendicular to and off axis to the cartridge feeder piston track bore 21.

As illustrated in FIG. 2, a cartridge magazine locking assembly handle slot 41 is defined by the weapon housing 3. The cartridge magazine locking assembly handle slot 41 is disposed perpendicular to the cartridge magazine locking assembly bore 33, and extends from the exterior of the weapon housing 3 to the cartridge magazine locking assembly bore 33.

Figure 7:
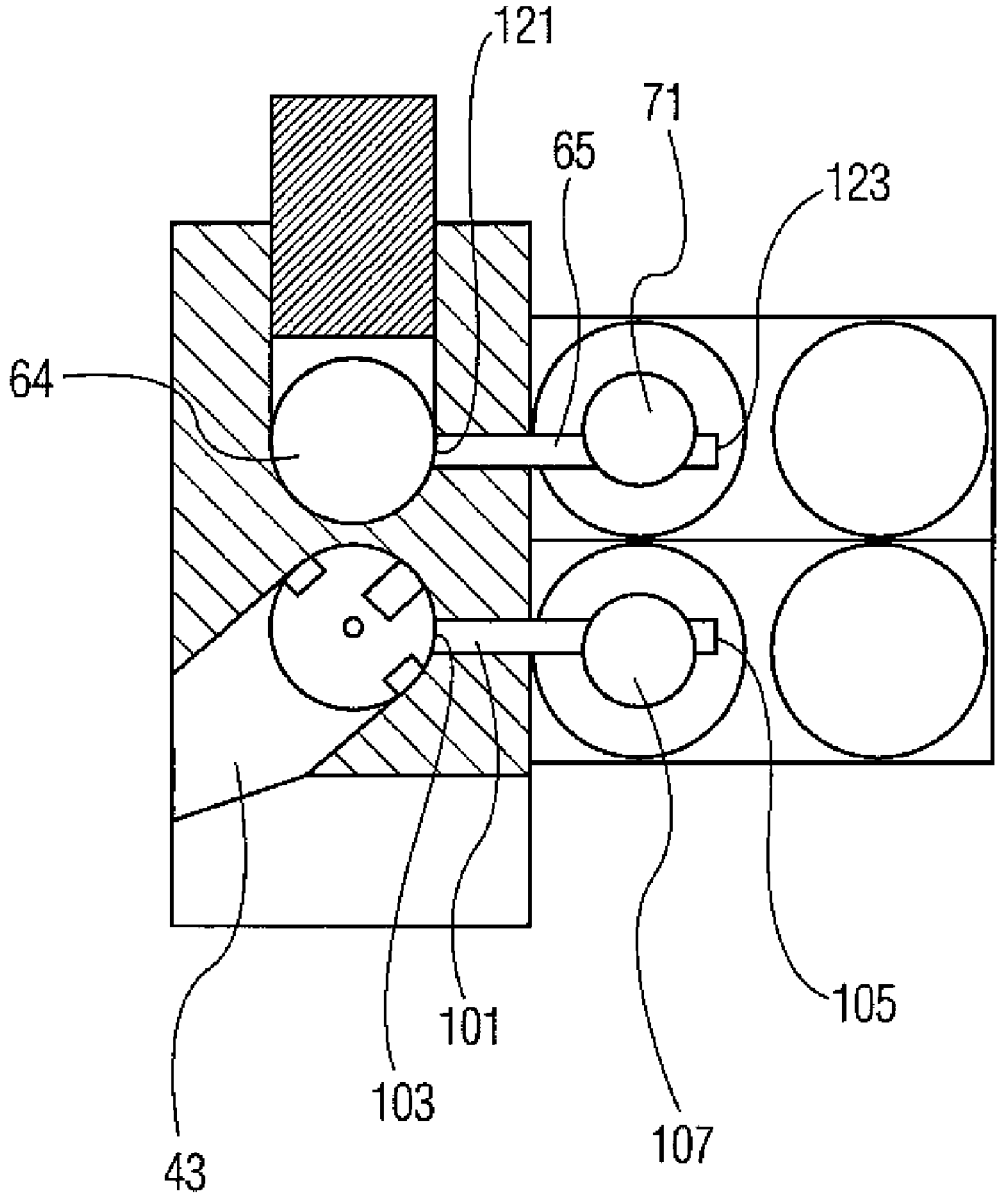
FIG. 7 is a cross sectional view of the electrically actuated weapon system of the present invention, taken perpendicular to the view shown in FIG. 2, adjacent the area of the extractor actuator through slot 17 shown in FIG. 2.

As illustrated in FIG. 7, a cartridge ejection slot 43 is defined by the weapon housing 3. The cartridge ejection slot 43 is disposed perpendicular to and off axis of the cartridge feeder piston track bore 21 (shown in FIG. 2), and in the same plane as the ejector rod bore 39 shown in FIG. 8. Preferably, as shown in FIG. 7, the cartridge ejection slot 43 is disposed perpendicular to and off axis by about 45° in relation to the cartridge feeder piston track bore 21, and in the same plane as the ejector rod bore 39 shown in FIG. 8.

Figure 3A:
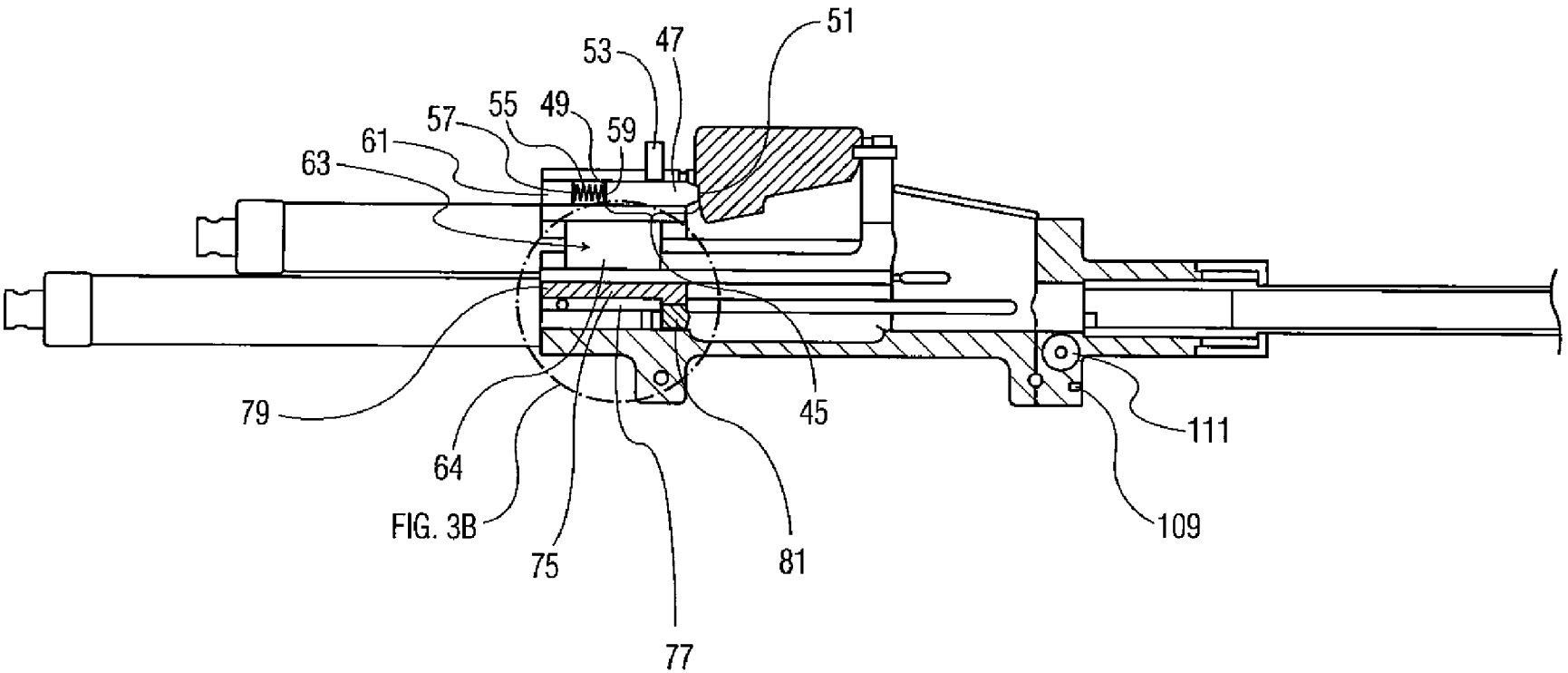
FIG. 3(*a*) is a partially cut away side view of the electrically actuated weapon of the present invention.

A cartridge magazine locking assembly 45, as illustrated in FIG. 3(A), is movably disposed in the cartridge magazine locking assembly bore 33 (shown in FIG. 2). As illustrated in FIG. 3(A), the cartridge magazine locking assembly 45 is comprised of a cartridge magazine locking assembly piston 47 having a rear end 49 and a front end 51. The cartridge magazine locking assembly piston 47 is slidably disposed within the cartridge magazine locking assembly bore 33.

A handle 53 is provided in communication with the cartridge magazine locking assembly piston 47. In particular, the handle 53, shown in FIG. 3(A), is disposed perpendicular to and slidably disposed within the cartridge magazine locking assembly handle slot 41, shown in FIG. 2. As illustrated in FIG. 3(A), a spring 55, having a first end 57 and a second end 59, is disposed within the cartridge magazine locking assembly bore 33, the second end 59 of the spring 55 being disposed adjacent to the rear end 49 of the cartridge magazine locking assembly piston 47. A plug 61 is removably disposed at the rear end of the cartridge magazine locking assembly bore 33, and adjacent to the first end 57 of the spring 55.

A cartridge extractor piston assembly 63, as illustrated in FIG. 3(*a*), is disposed within the extractor piston track bore 15 (shown in FIG. 2). The cartridge extractor piston assembly 63 is comprised of a cartridge extractor piston 64 slidably disposed within the extractor piston track bore 15. As illustrated in FIGS. 4 and 7, an extractor actuator rod 65, having a first end 121 and second end 123, is disposed perpendicular to the cartridge extractor piston 64 shown in FIG. 3(A), slidably disposed within the extractor actuator through-slot 17 shown in FIG. 2, and is in communication with the cartridge extractor piston 64 at the first end 121 of the extractor actuator rod 65.

As illustrated in FIGS. 1 and 4, an extractor linear actuator means 71 is disposed adjacent to the weapon housing 3, and is in communication with the second end 123 of the extractor actuator rod 65, such that the extractor linear actuator means 71 operates to slide the cartridge extractor piston 64 within the extractor piston track bore 15 (shown in FIG. 2) via the extractor actuator rod 65. As illustrated in FIG. 8, an ejector rod 73 is disposed within the ejector rod bore 39, perpendicular to and off axis of the cartridge feeder piston track bore 21 (shown in FIG. 2). Preferably, as illustrated in FIG. 8, the ejector rod 73 is disposed within the ejector rod bore 39 perpendicular to and off axis at about a 45° angle in relation to the cartridge feeder piston track bore 23 (shown in FIG. 2).

Figure 9:
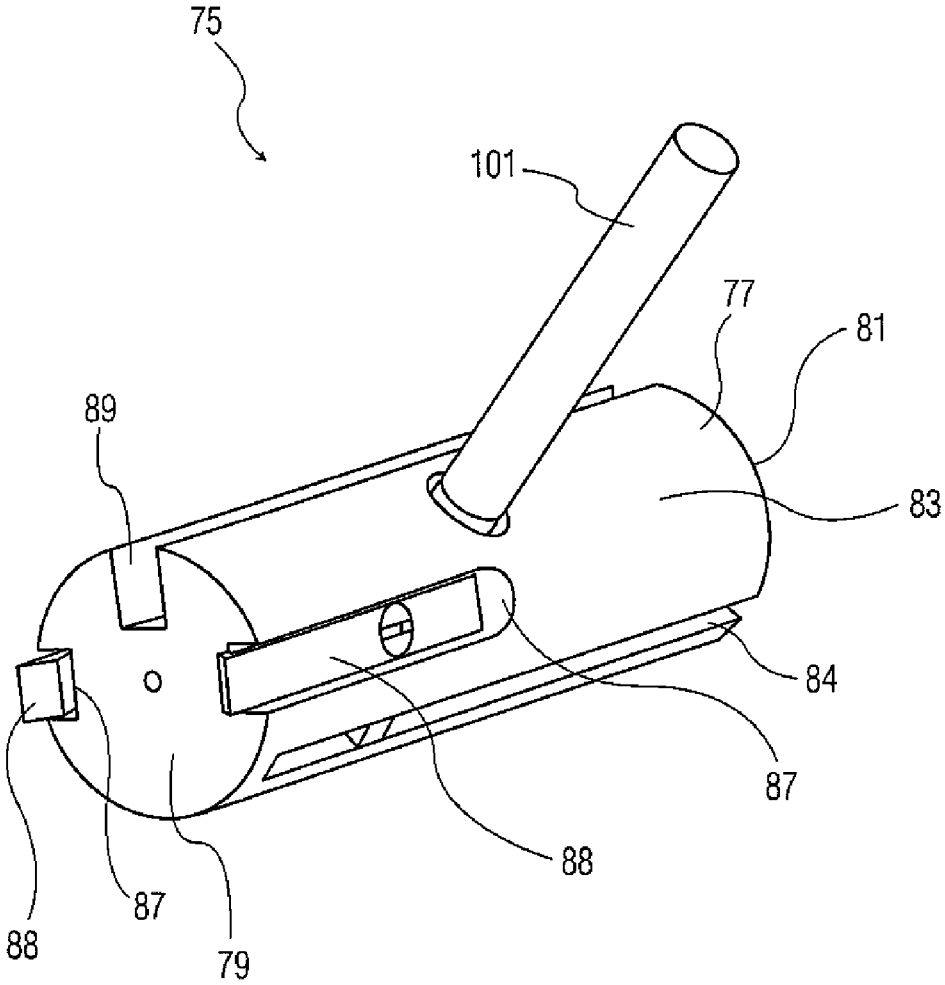
FIG. 9 is a perspective view of the cartridge feeder piston assembly of the electrically actuated weapon of the system of the present invention.

As illustrated in FIGS. 2 and 9, a cartridge feeder piston assembly 75 is disposed within the feeder piston track bore 21 (shown in FIG. 2). As shown in FIG. 9, the cartridge feeder piston assembly 75 is comprised of a cartridge feeder piston 77 having a first end 79, a second end 81, and a circumferential portion 83 disposed there between. The cartridge feeder piston 77 is slidably disposed within the feeder piston track bore 21.

Figure 3B:
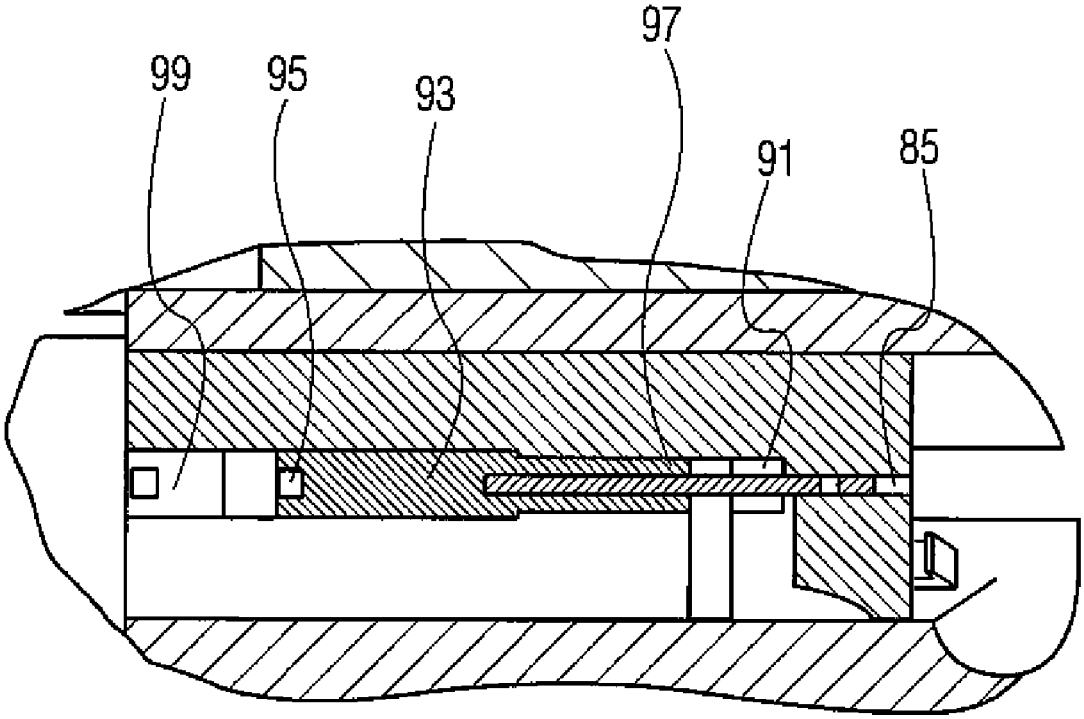
Figure 4:
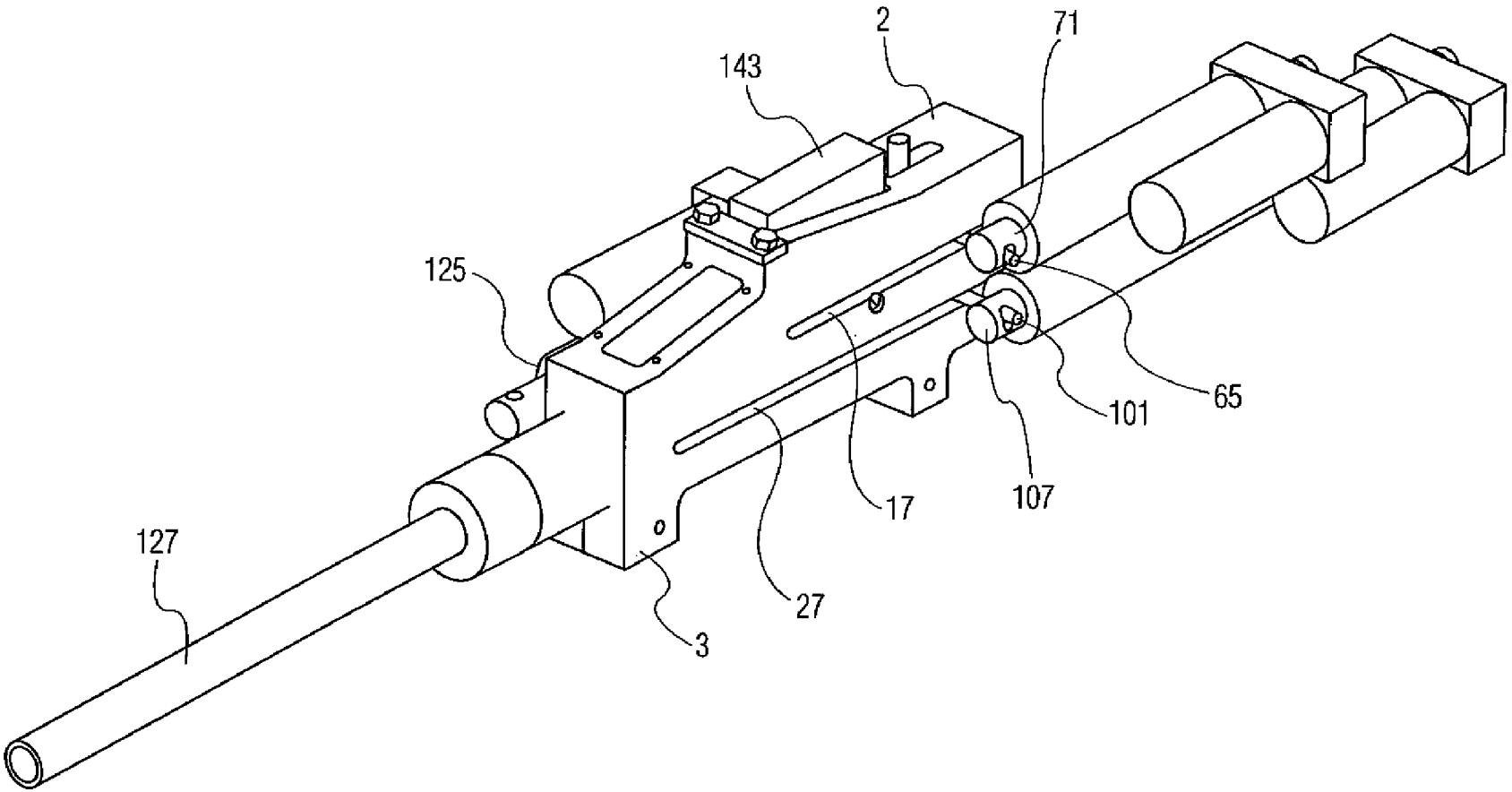
FIG. 4 is a partial perspective view of the electrically actuated weapon of the present invention, illustrating the opposite side of the weapon shown in FIG. 1.

As illustrated in FIG. 3(B), a firing pin bore 85 is disposed through the side of the cartridge feeder piston 77 (shown in FIG. 9), from the first end 79 of the piston to the second end of the piston. The firing pin bore 85 has a diameter, adjacent the first end 79 of the cartridge feeder piston 77, smaller than a diameter adjacent the second end 81 of the cartridge feeder piston 77.

As illustrated in FIG. 9, a firing pin slot 84, defined by the cartridge feeder piston, is disposed perpendicular to firing pin bore 85, illustrated in FIG. 3(B), and extending from the exterior of the cartridge feeder piston 77 to the firing pin bore 85. The firing pin slot 84 has a width smaller than the diameter of the firing pin bore 85. As illustrated in FIG. 3(B), a plug 99 is removably disposed at the rear end of the firing pin bore 85, and adjacent to the first end 95 of the firing pin spring 93.

As further illustrated in FIG. 3(B), a firing pin 91 is slidably disposed within the firing pin bore 85 and the firing pin slot 84. A firing pin spring 93, having a first end 95 and a second end 97, is also disposed within the firing pin bore 85, the second end 97 of the spring 93 being disposed adjacent to the rear end of the firing pin 91.

The cartridge feeder piston 77 further has a plurality of extractor finger grooves 87, 87, and an extractor rod groove 89, disposed therein. The extractor finger grooves 87, 87, are formed in and are defined by the cartridge feeder piston. An extractor finger 88 is disposed within each of the extractor finger grooves 87. Each extractor finger 88 is composed of a flexible memory retaining material (such as spring steel), which is capable of temporarily deforming, so as to grasp the rear lip of the ammunition cartridge.

As shown in FIG. 9, an ejector rod groove 89 is disposed within the cartridge feeder piston 77, and extends the entire length thereof. As shown in FIG. 8, the ejector rod 73 is movably disposed within the ejector rod groove 89 and the ejector rod bore 39.

As illustrated in FIG. 7, a feeder actuator rod 101, having a first end 103 and second end 105, is disposed perpendicular to the cartridge feeder piston 77 (shown in FIG. 9). The feeder actuator rod 101 is slidably disposed within the feeder actuator through-slot 27 shown in FIG. 2, and is in communication with the cartridge feeder piston 77 at the first end 103 of the feeder actuator rod 101.

A feeder linear actuator means 107, as shown in FIGS. 4 and 7, is disposed adjacent to the weapon housing 3, and in communication with the second end 105 of the feeder actuator rod 101. The feeder linear actuator means 107, which may be any electrical or hydraulic linear actuator, slides the cartridge feeder piston 77 within the feeder piston track bore 19 (shown in FIG. 2) via the feeder actuator rod 101.

Figure 6:
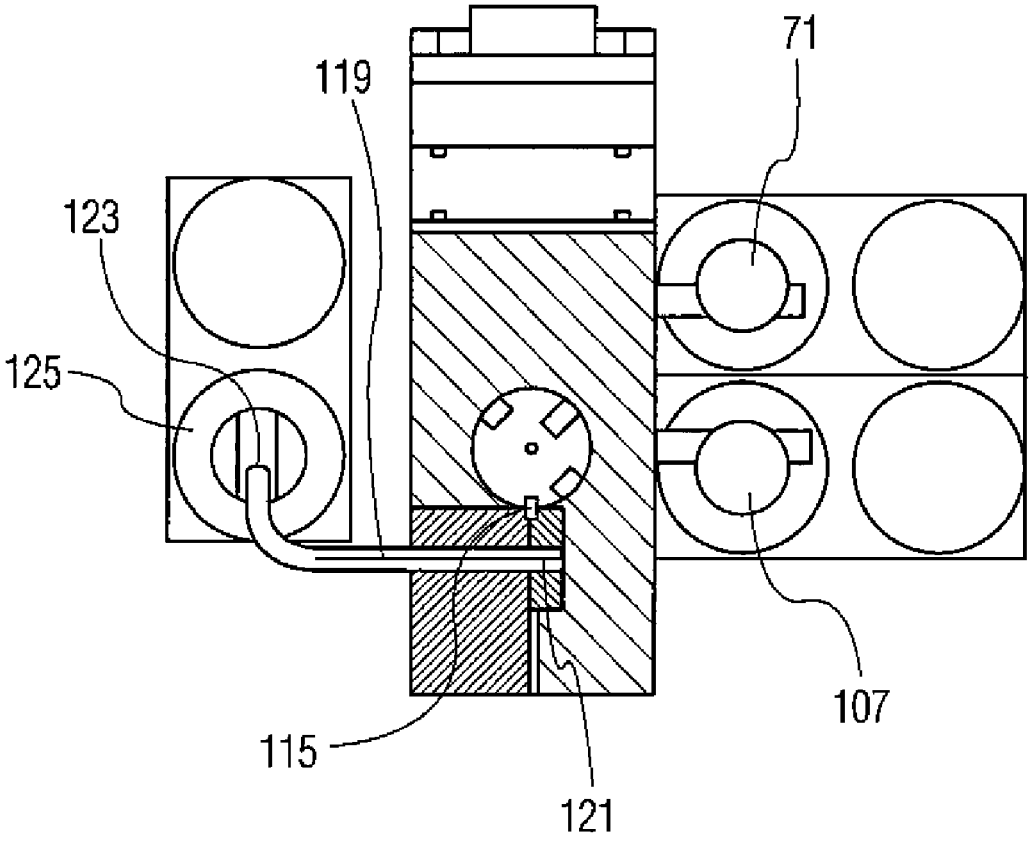
FIG. 6 is a cross sectional view of the electrically actuated weapon of the system of the present invention, taken perpendicular to the view shown in FIG. 2, adjacent the area of the firing pin cam bore 35 shown in FIG. 2.

As illustrated in FIG. 3(A), a firing pin cam assembly 109 is disposed in the firing pin cam bore 35 shown in FIG. 2. The firing pin cam assembly 109 is comprised of a trigger cam 111, as shown in FIG. 3(A), having a trigger cam hole 113 disposed therethrough, as shown in FIG. 1, which is movably disposed within the firing pin cam bore 35. A cam pin 115, as shown in FIG. 6, is disposed within the trigger cam hole 113, such that the cam pin 115 is in movable communication with the trigger cam 111 (FIG. 3A). A firing pin cam cover 117, as shown in FIG. 1, is disposed on the weapon housing 3, adjacent the firing pin cam bore 35 (FIG. 2).

Figure 5:
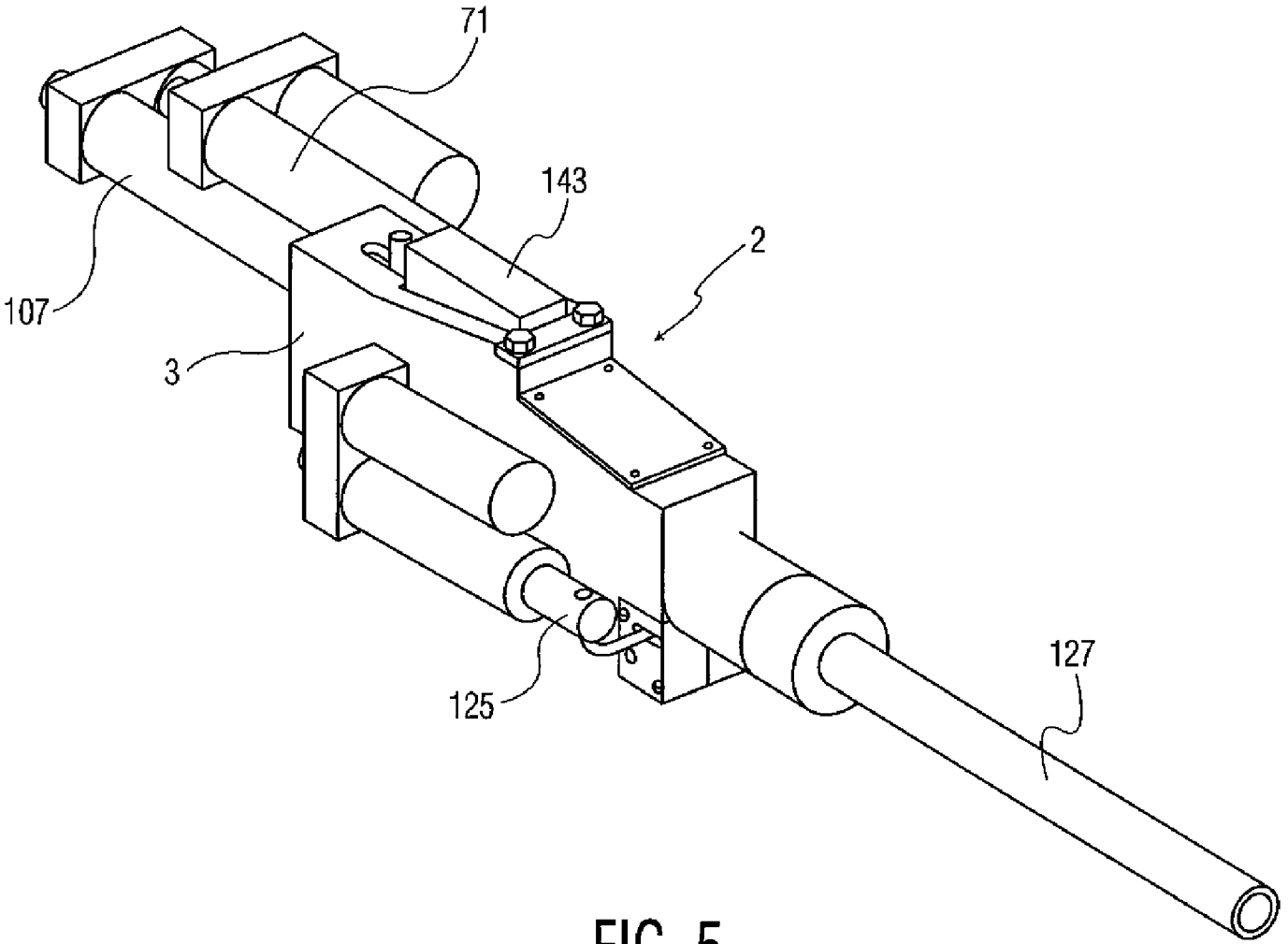
FIG. 5 is a partial perspective view of the electrically actuated weapon of the system of the present invention.

As illustrated in FIG. 6, a cam actuator rod 119, having a first end 121 and second end 123, is disposed perpendicular to and in communication with the cam pin 115. The cam actuator rod 119 is also rotatably disposed adjacent the firing pin cam bore 35 (FIG. 2). A cam actuator means 125, as shown in FIGS. 1 and 5, is disposed adjacent to the weapon housing 3, and in communication with the second end 123 of the cam actuator rod 119. Like the extractor linear actuator means 71 and the feeder linear actuator means 107, the cam actuator means 125 may be any electrical or hydraulic linear actuator. The cam actuator means 125 operates to rotate the cam actuator rod 119 within the firing pin cam bore 35 via the cam actuator rod 119 shown in FIG. 6.

Method of Operation:

The electrically actuated weapon system 1 of the present invention operates as follows:

Pre-Fire Configuration of the Weapon:

Before the firing sequence is initiated, the following conditions exist:

- The cartridge extractor piston 64 (FIG. 3A) is in the retracted position, i.e, is positioned at the rear most position in the extractor piston track bore 15 (FIG. 2).
- The cartridge feeder piston 77 (FIG. 3A) is in the retracted position, i.e., is positioned at the rear most position in the feeder piston bore 21 (FIG. 2).
- The firing pin cam assembly 109 (FIG. 3A) is in the start position, i.e., the cam pin 115 (FIG. 6) on the cam is rotated to the forward most position.
- There is ammunition in the magazine
- There is no ammunition in the interior of the weapon housing 3 (FIG. 4), the extractor piston track 13 (FIG. 2), or the feeder piston bore 21 (FIG. 2).
- None of the linear actuator means 71, 107, 125, (see FIG. 1) are powered, and are in the retracted position.

Firing Process of the Weapon:

The following sequence of actions takes place during the firing process of the electrically actuated weapon system of the present invention:

1. On the controller means 142 (FIG. 1), the "first" switch is engaged, so as to direct power to the extractor linear actuator means 71.
2. The extractor linear actuator means 71 is now moved to the extended position, which moves the cartridge extractor piston assembly 63 (FIG. 3A) along the extractor piston track bore 15 (FIG. 2), extracting one weapon cartridge from the ammunition supply means 143 (FIG. 1), and pushing the weapon cartridge along the extractor piston track bore 15 (FIG. 2).
3. The weapon cartridge is allowed to pass through the transition cavity 31 (FIG. 2), and reside in the feeder piston bore 21 (FIG. 2).
4. The extractor linear actuator means 71 is now stopped in the extended position, which prevents any subsequent Cartridges from being extracted, and internally disconnects all power from the extractor linear actuator means 71.
5. On the controller means 142, the "second" switch is then engaged, directing power to the feeder linear actuator means 107.
6. The feeder linear actuator means 107 is now moved to the extended position, which moves the cartridge feeder piston assembly 75 (FIG. 3A) along the feeder piston bore 21 (FIG. 2), moves the cartridge into the chamber 133 of weapon barrel 127, and locks the extractor fingers 88 (FIG. 9) onto the weapon cartridge flange.

7. The feeder linear actuator means 107 is now stopped in the extended position, which seals the weapon cartridge into the chamber 133 of weapon barrel, and internally disconnects all power from the feeder linear actuator means 107.

8. On the controller means 142, the "third" switch is now engaged, directing power to the cam actuator means 125.

9. The cam actuator means 125 is now moved to the extended position, which rotates the firing pin cam assembly 109 (FIG. 3A) counterclockwise 90°. This retracts the firing pin 91 (FIG. 3B) against the firing pin spring 93, and then releases the firing pin 91 so it then impacts the primer located at the rear of the weapon cartridge, thereby initiating the propelling charge.

10. The cam actuator means 125 is now stopped in the extended position, which internally disconnects all power from the cam actuator means 125.

11. On the controller means 142, the "second" switch is reengaged, directing power to the feeder linear actuator means 107.

12. The feeder linear actuator means 107 is now moved to the retracted position, which moves the cartridge feeder piston assembly 75 (FIG. 3A) along the feeder piston bore 21 (FIG. 2). This pulls the expended weapon cartridge out of the chamber 133 of the weapon barrel, along the feeder piston bore 21, and into the ejector rod 73 (FIG. 8), forcing the expended weapon cartridge loose from the extractor fingers 88 (FIG. 9), ejecting the expended weapon cartridge out of the weapon housing 3 through the cartridge ejection slot 43 (FIG. 7).

13. The feeder linear actuator means 107 is now stopped in the retracted position, which internally disconnects all power from the feeder linear actuator means 107.

14. On the controller means 142, the "third" switch is then reengaged, directing power to the cam actuator means 125.

15. The cam actuator means 125 is now moved to the retracted position, which rotates the firing pin cam assembly 109 clockwise 90°.

16. The cam actuator means 125 is now stopped in the retracted position, which internally disconnects all power from the cam actuator means 125.

17. On the controller means 142, the "first" switch is then reengaged, directing power to the extractor linear actuator means 71.

18. The extractor linear actuator means 71 is now moved to the retracted position, which moves the cartridge extractor piston assembly 63 along the extractor piston track bore 15.

19. The extractor linear actuator means 71 is now stopped in the retracted position, which internally disconnects all power from the extractor linear actuator means 71.

After the above process is completed, the electrically actuated weapon system is in the pre-fire configuration, as described above, and is ready to begin the firing process as described above.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. An electrically actuated weapon system comprising:

(A) a control means;

(B) a receiving means in wireless communication with said control means;

(C) a weapon control means in communication with the receiving means, said weapon control means operable to control firing operation of the weapon via actuating means; and (D) an electrically actuated weapon in communication with the weapon control means, the electrically actuated weapon comprised of a:

(1) a feeder linear actuating means operable to control feeding of ammunition into the weapon;

(2) a cam actuating means operable to control firing operation of the weapon; and (3) an extractor linear actuating means for extracting fired weapon cartridges from the weapon.

2. The electrically actuated weapon system of claim 1, wherein the control means is a computer processing means or a simple logic control device operable to communicate with the weapon control means.

3. The electrically actuated weapon system of claim 1, wherein the weapon control means is a computer processing means or a simple logic control device, and is capable of controlling operation of the linear actuating means.

4. The electrically actuated weapon system of claim 1, further comprising a power supply in communication with the weapon control means.

* * * * *